United States Patent [19]

Suzuki et al.

[11] 4,264,968

[45] Apr. 28, 1981

[54] BASIC CIRCUIT FOR ELECTRONIC TIMEPIECES

[75] Inventors: Yasoji Suzuki, Kanagawa; Fuminari Tanaka, Yokohama; Yasushi Sato, Oita, all of Japan

[73] Assignee: Tokyo Shibaura Electric Co., Ltd., Japan

[21] Appl. No.: 864,714

[22] Filed: Dec. 27, 1977

[30] Foreign Application Priority Data

Dec. 27, 1976 [JP] Japan ..... 51-158349

[51] Int. Cl.[3] ..... G04C 3/00

[52] U.S. Cl. ..... 368/201; 368/155

[58] Field of Search ..... 58/23 R, 85.5, 23 AC, 58/23 BA; 328/37, 39, 46; 368/200, 201, 155, 156

[56] References Cited

U.S. PATENT DOCUMENTS

| | | | |
|---|---|---|---|
| 3,426,180 | 2/1969 | Smith | 328/39 |
| 3,484,699 | 12/1969 | Israel | 328/46 |
| 3,829,713 | 8/1974 | Canning | 328/46 |
| 3,930,169 | 12/1975 | Kuhn, Jr. | 328/46 |
| 4,034,550 | 7/1977 | Kouchi et al. | 58/23 R |
| 4,044,546 | 8/1977 | Koike | 58/23 R |
| 4,065,915 | 1/1978 | Farnbach | 58/23 R |
| 4,086,752 | 5/1978 | Kishimoto | 58/23 BA |
| 4,090,350 | 5/1978 | Nomura | 58/23 R |
| 4,150,537 | 4/1979 | Mochizuki et al. | 58/85.5 |
| 4,176,517 | 12/1979 | Yoshida | 368/201 |

OTHER PUBLICATIONS

"Watch Chip Is Programmable," Electronics, Apr. 29, 1976.

*Primary Examiner*—J. V. Truhe
*Assistant Examiner*—Forester W. Isen
*Attorney, Agent, or Firm*—Finnegan, Henderson, Farabow, Garrett & Dunner

[57] ABSTRACT

There is provided an electronic timepiece basic circuit comprising a pulse generating circuit for generating 1 Hz pulses, a first terminal group having a plurality of terminals including a terminal connected to the output terminal of the pulse generating circuit, a second terminal group having terminals to be connected to the terminals of the first terminal group, respectively, 10 scale counters coupled with the second terminal group, 6 scale counters connected to the 10 scale counters, a display unit, and a decoder which is coupled with the 10 scale counters and the 6 scale counters and decodes the contents of the 10 and 6 scale counters and delivers the decoded contents to the display unit. The first and second terminal groups are properly coupled to each other. The combination of the 10 scale counters and the 6 scale counters is properly modified so as to form a 12, 24, or 60 scale counter, as necessary.

16 Claims, 15 Drawing Figures

BASIC CIRCUIT FOR ELECTRONIC TIMEPIECES

BACKGROUND OF THE INVENTION

The present invention relates to a basic circuit for electronic timepieces.

Generally, the circuit of an electronic timepiece is made by a large scale integrated circuit and is mainly constituted by an oscillating and frequency-dividing section, a counter and decoder section for counting second, minute, day, month, etc. and converting the count value into the corresponding time information, and a switching circuit section for selecting time to be displayed, and for correcting time.

The requirements of users for the system design of the electronic timepiece are various and therefore different system designs must be made by manufacturers to conform with such various requirements. General differences of the requirements for the system design are the display position of second, minute, hour, day, etc. and the number of switches to be used. Therefore, there is no need for modifying the oscillating and frequency-dividing section, but there is a need for changing wiring in the counter and decoder section and the switching circuit section.

SUMMARY OF THE INVENTION

An object of the present invention is to provide a basic circuit for electronic timepieces with wirings of the circuits to be easily made and modified in accordance with the specifications by user.

According to one aspect of the present invention, there is provided a basic circuit for electronic timepieces comprising: a switching circuit including at least one switch and connected to generate a control signal in response to the operating condition of the switch; an oscillating circuit; a frequency dividing circuit coupled with the oscillating circuit; a first terminal group having a plurality of first terminals including a terminal connected to the frequency dividing circuit; a second terminal group having a plurality of second terminals which are equal in number to the first terminals; a counter circuit including a plurality of counters whose input terminals are connected with the second terminals, the output terminals of the counters except the final stage counter being connected with the first terminals except one connected to the frequency divider, respectively; a display mode selection circuit which, in response to a control signal from the switching circuit, feeds selectively the output signal to the decoder circuit; and a display circuit coupled with the decoder.

DETAILED DESCRIPTION OF THE PREFERRED EMBODIMENT

Figure 1:
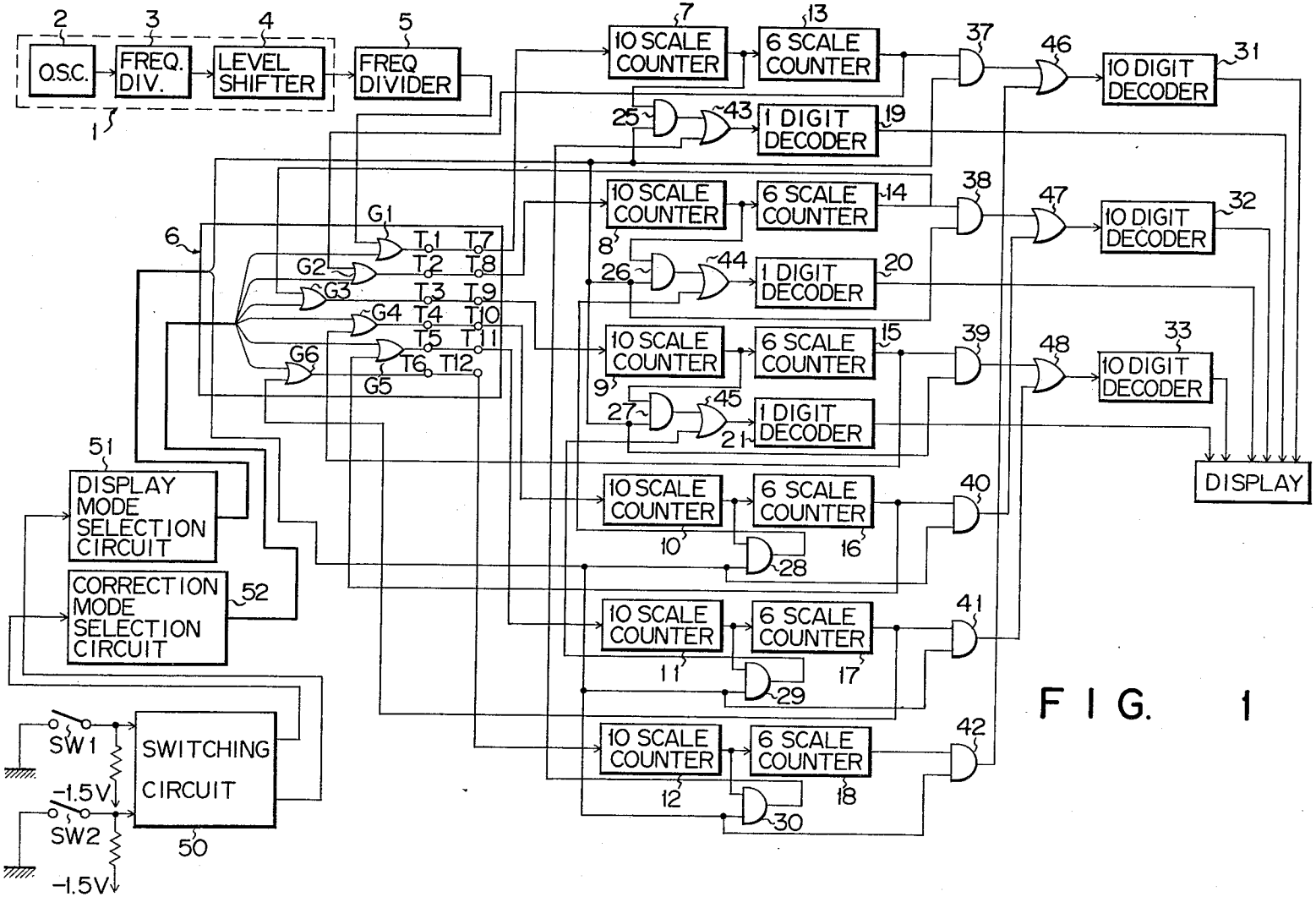
FIG. 1 shows a circuit diagram of a basic circuit for electronic timepieces which is an embodiment of the present invention.

FIG. 1 shows a circuit diagram of an electronic timepiece formed by using an electronic timepiece basic circuit which is an embodiment of the present invention. A pulse generating circuit 1 includes a crystal oscillator 2 with the oscillating frequency 32.768 KHz, a frequency divider 3 for frequency-dividing the oscillating frequency up to 128 Hz, and a level shifter 4 for shifting the output of the frequency divider 3 to 3 V. The output signal of the frequency divider 5 is applied to a read only memory (ROM) 6 including a display mode switching path, a time correction path, a first terminal group having a plurality of terminals T1 to T6, and a second terminal group having a plurality of terminals T7 to T12. In this example, the first terminals T1 to T6 are connected with second terminals T7 to T12, respectively, as shown, and the output of the frequency divider 5 is coupled with the first terminal T1, through an OR gate G1. The second terminals T7 to T12 are respectively coupled with the inputs of 10 scale counters 7 to 12 which are "second counter", "minute counter", "hour counter", "day counter", "month counter" and "year counter". The 10 scale counters 7 to 12 are further coupled with 6 scale counters 13 to 18 for second, minute, hour, day, month and year, respectively. The outputs of the 6 scale counters 13 to 17 are coupled with the first terminals of T2 to T6, through OR gates G2 to G6. With such connections, the 10 scale counters 7 to 12 count the first digits of the measured time; second, minute, hour, day, month and year. The 6 scale counters 13 to 17 count the 10th digits of the same elements.

The output terminals of the 10 scale counters 7 to 9 and coupled with "1" digit decoders 19 to 21, through AND gates 25 to 27 and OR gates 43 to 45. The output terminals of the 10 scale counters 10 to 12 are respectively connected to the "1" digit counters 20, 21 and 19 through AND gates 28 to 30 and the OR gates 44, 45 and 43. The 6 scale counters 13 to 15 are coupled with "10" digit decoders 31 to 33, through AND gates 37 to 39 and OR gates 46 to 48. The 6 scale counters 16 to 18 are connected to "10" digit decoders 31 to 33 through AND gates 40 to 42 and OR gates 47, 48 and 46. The output terminals of the "1" digit decoders 19 to 21 and the "10" digit decoders are coupled with a display unit 49.

A switching circuit 50, in response to operation of switches SW1 and SW2, generates switching signals which control the operation of a display mode selection circuit 51 and a correction mode selection circuit 52. The display mode selection circuit 51 has two output lines; one is connected commonly to AND gates 25, 26, 27, 37, 38 and 39, and the other commonly to AND gates 28, 29 30, 40, 41 and 42. The signals bearing on these two lines are inverted to each other and their states are inverted each time the switch SW1, for example, is operated. In other words, through the operation of the switch SW1, second, minute and hour group and year, month and day group are alternately displayed on the display unit 49.

The correction mode selection circuit 52 is provided with output lines coupled with the first terminals T1 to T6, through OR gates G1 to G6. By actuation of the switches SW1 and SW2, the correction mode selection circuit 52 successively drives the 10 scale counters 7 to 12, through one of the OR gates G1 to G6, to select the digit to be corrected, i.e. one of second, minute, hour, day, month and year.

The switching circuit 50, the display mode selection circuit 51 and the correction mode selection circuit 52 are disclosed in U.S. Patent Application Ser. No. 679,791, for example.

Figure 2:
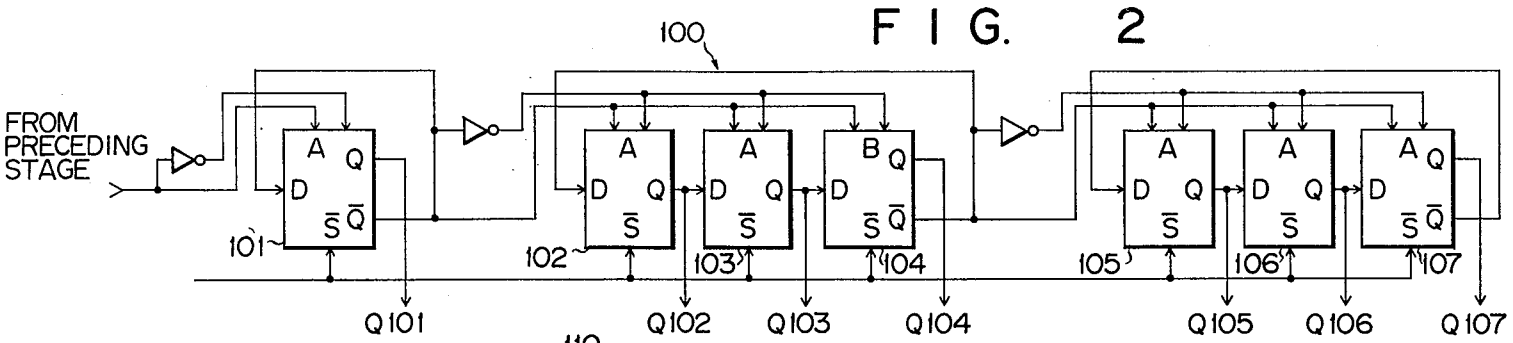
FIG. 2 shows the details of a 10 scale counter and a 6 scale counter shown in FIG. 1.

FIG. 2 shows a detailed circuit of a 60 scale counter 100 for counting seconds, or minutes which is used in FIG. 1. The 60 scale counter 100 is provided with a 10 scale counter section to be subsequently described and a 6 scale counter section. The 10 scale counter section is comprised of a binary counter 101, one-bit shift registers 102 and 103, and a modified one-bit shift register 104. The 6 scale counter includes three one-bit shift registers 105 to 107. An hour counter of 24 scale, a day counter of 60 scale, and a month counter of 12 scale are constructed on the basis of the circuit shown in FIG. 2.

Figure 3:
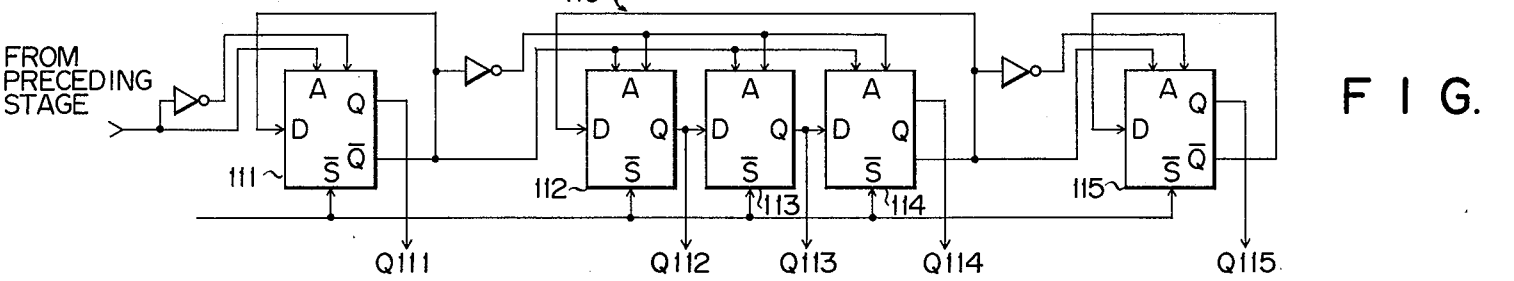
FIG. 3 shows a circuit diagram of a 24 scale counter which is a modification of the circuit shown in FIG. 2.

FIG. 3 shows a 24 scale counter 110 for hours. The 24 scale counter is provided with a 12 scale counter section including a binary counter 111, and one-bit shift registers 112 to 114, and a binary counter section including a single one-bit shift register 115. The hour counter 110 is formed by modifying the modified one-bit shift register 104 of the 60 scale counter shown in FIG. 2 to one-bit shift register 114, and electrically insulating the one-bit shift registers 106 to 107 from the one-bit shift register 105, and properly changing the connection of the one-bit shift register 105.

Figure 4:
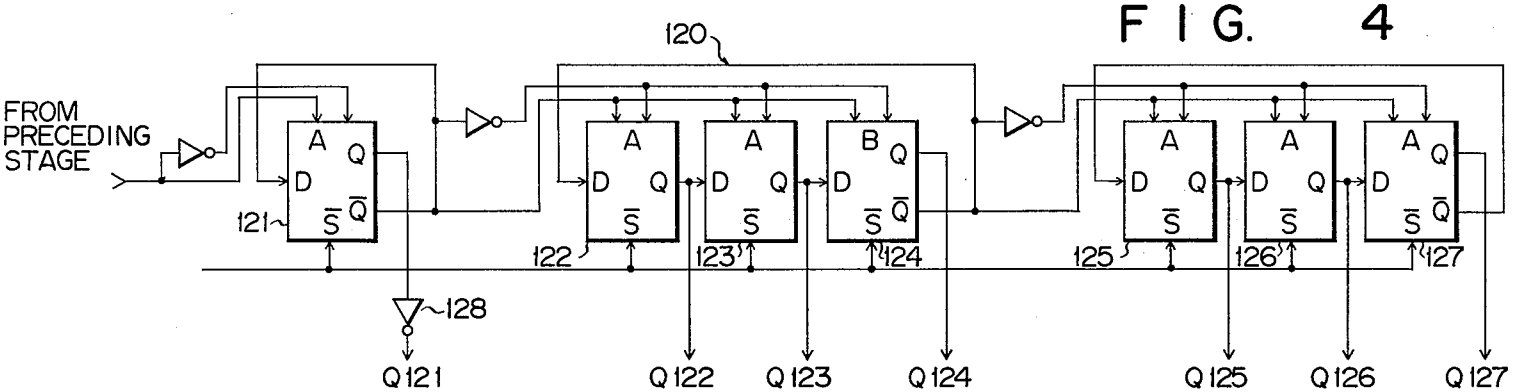
FIG. 4 is a circuit diagram of a 60 scale counter which is a modification of the circuit of FIG. 2.

FIG. 4 shows a 60 scale counter 120 for days which is provided with a 10 scale counter section having a binary counter 121, one-bit shift registers 122 and 123 and a modified one-bit shift register 124, and a 6 scale counter section having three one-bit shift registers 125 to 127. The 60 scale counter for days is formed by connecting an inverter 128 to the output terminal Q of the binary counter 101 of the 60 scale counter 100 shown in FIG. 2.

Figure 5:
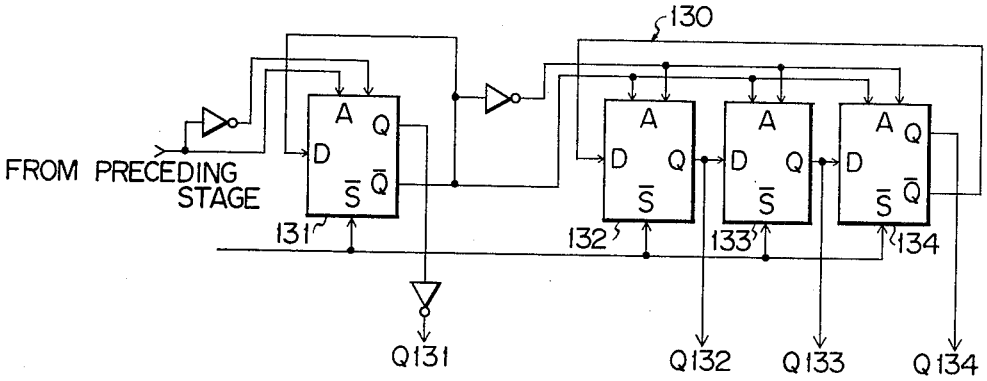
FIG. 5 is a circuit diagram of a 12 scale counter which is a modification of the circuit of FIG. 2.

FIG. 5 shows a 12 scale counter 130 for months including a 12 scale counter section having a binary counter 131 and one-bit shift registers 132 to 134. The 12 scale counter 130 for months is formed by connecting an inverter 138 to the output terminal Q of the binary counter 101 of the 60 scale counter 100 shown in FIG. 2, electrically isolating the modified one-bit shift register 104 from the one-bit shift registers 105 to 107, and modifying the modified one-bit shift register 104 to the one-bit shift register 134. To the reset terminal $\overline{S}$ of the counters shown in FIGS. 2 to 5, a reset pulse, generated when a power source for the electronic timepiece is turned on, is applied to place all the counters to be in a reset state, i.e. in an initial state. After this, a high level signal is applied to the reset terminal $\overline{S}$ to return to its normal state.

Figure 6:
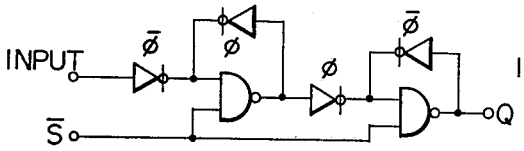
FIGS. 6 and 7 are circuit diagrams of a one-bit shift register and a modified one-bit shift register which are used in the circuit of FIG. 2.
Figure 7:
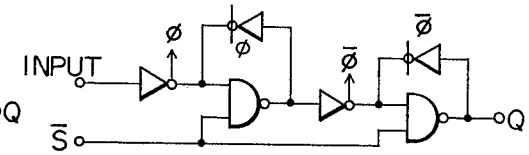
Figure 8:
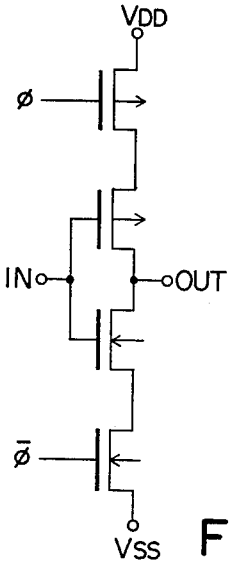
FIGS. 8 and 9 are circuit diagrams of clocked inverters used in the circuits in FIGS. 6 and 7.
Figure 9:
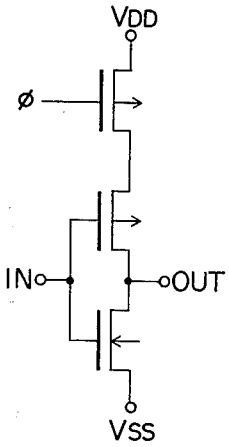

FIG. 6 shows the detail of the binary counter 101, one-bit shift registers 102, 103 and 105 to 107 of the 60 scale counter 100 in FIG. 2 and the detail of the modified one-bit shift register 104. As seen from comparison between FIGS. 6 and 7, the one-bit shift register and the modified one-bit shift register have the same circuit construction except the construction of the clocked inverter used. The clocked inverter used in the one-bit shift register shown in FIG. 6 is comprised of four FET's as shown in FIG. 8 and there are inverted only when clock pulses $\phi$ and $\overline{\phi}$ are in a given level. The clocked inverters connected in parallel with respective NAND gates in the modified one-bit shift register shown in FIG. 7 are each constructed of four FET's as shown in FIG. 8 and the other inverters are each comprised of three FET's as shown in FIG. 9. For "0" level of its data input, the clocked inverter is inverted only when the clock pulse $\phi$ or $\overline{\phi}$ is in a given level. For "1" level of the input, it is inverted independently of the level of the clock pulse $\phi$ or $\overline{\phi}$. In the inverters shown in FIGS. 8 and 9, the clock pulses $\phi$ and $\overline{\phi}$ may be alternately applied thereto.

As seen from the above, the one-bit shift register and the modified shift register may be easily exchanged by exchanging clocked inverters shown in FIGS. 8 and 9.

Figure 12:
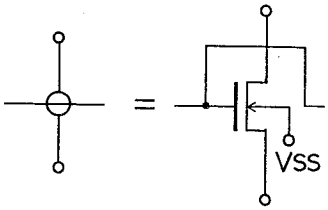
FIGS. 12 and 13 are circuit diagrams of circuit components used in FIGS. 10 and 11.
Figure 13:
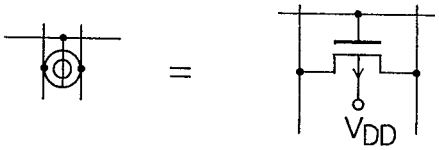
Figure 14:
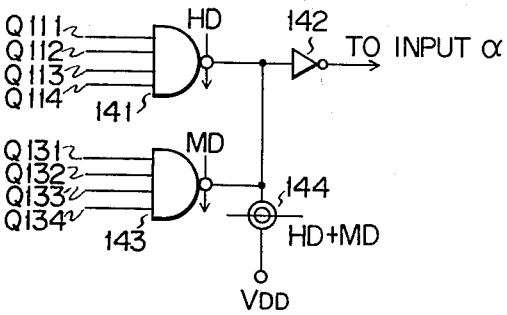
FIGS. 14 and 15 show circuit diagrams of signal generating circuits for providing specified signals to a decoder shown in FIGS. 10 and 11, respectively.
Figure 10:
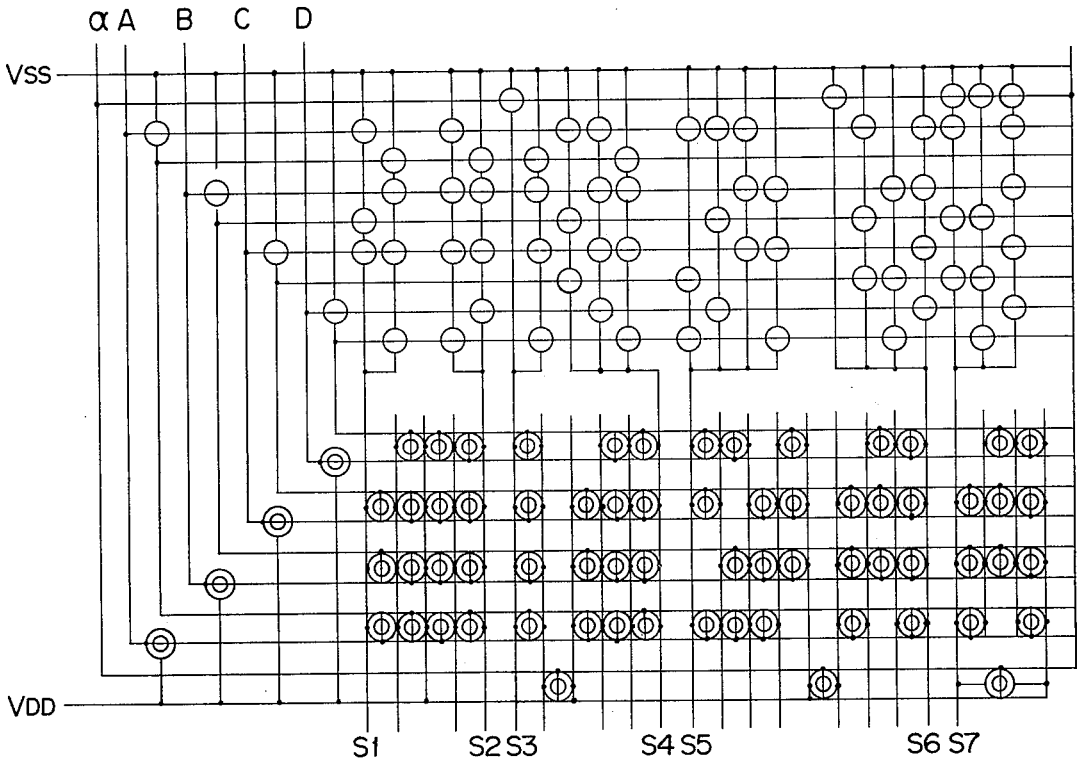
FIGS. 10 and 11 are circuit diagrams of a one digit decoder and a 10 digit decoder used in the basic circuit in FIG. 1.
Figure 11:
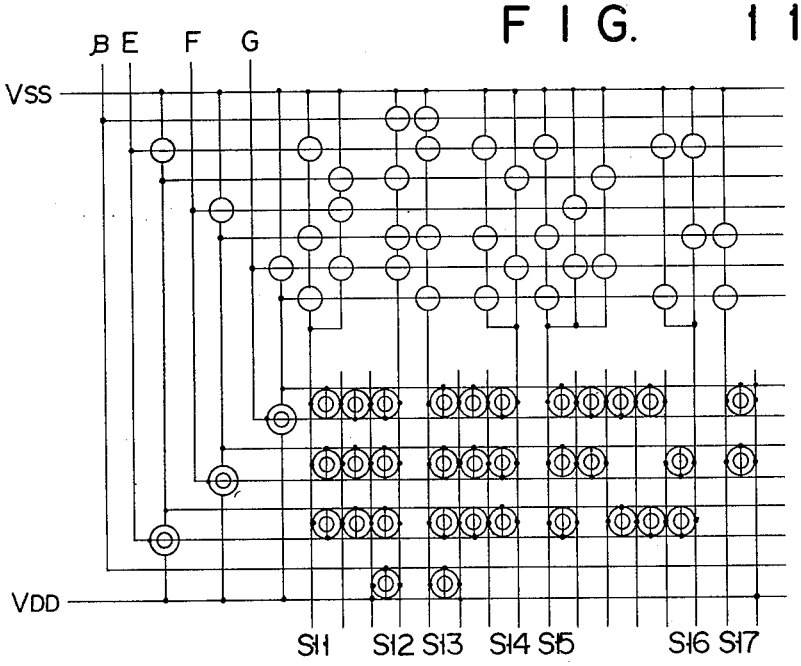

FIGS. 10 and 11 show the detailed circuit diagrams of the 1-digit decoders 19 to 24 and the 10-digit decoders 31 to 36 shown in FIG. 1. In these decoders, single and double circles show N-channel MOS transistors and P-channel MOS transistors, respectively, as shown in FIGS. 12 and 13. In the figures, $V_{SS}$ and $V_{DD}$ designate negative potential and ground potential. Input terminals A, B, C and D are connected to four stage one-bit shift registers of each counter, e.g. the output terminals Q of the binary counter 101, one-bit shift registers 102 and 103 and the modified one-bit shift register 104 of the counter 100, and input terminals D, E and F are coupled with the output terminals Q of the one-bit shift registers 105 to 107 of the counter 100, for example. An input terminal $\alpha$ provides a signal for changing the output of the decoder shown in FIG. 10, even if the output state of the counter is the same. For example, the output state of "0" of the 10 scale counter is equal to "1" output state of the 12 scale counter. In this case, the signal level at the input terminal $\alpha$ determines whether the output of the counter is a 12 scale value or a 10 scale value. The logic circuit shown in FIG. 14 is coupled with the input terminal $\alpha$. In the logic circuit, a clocked NAND gate 141 has input terminals connected to the output terminals Q111, Q112, Q113 and Q114 of the hour counter 110 and an output terminal coupled with an input terminal of the decoder in FIG. 10 through an inverter 142. When the hour display mode is selected by the display mode selection circuit 51 shown in FIG. 1, the clocked NAND gate 141 is driven by an HD clock signal generated from the display mode selection circuit 51, to produce an output signal through an inverter 142. A clocked NAND gate 143 has input terminals coupled with output terminals Q131, Q132, Q133 and Q134 of the month counter 130 shown in FIG. 5, and an output terminal coupled with the input terminal $\alpha$ through an inverter 142. The clocked NAND gate 143 is driven by an MD clock signal generated from the display mode selection circuit 51 when the month display mode is selected by the display mode selection circuit 51 producing an output signal through an inverter 142. The ground potential $V_{DD}$ is further supplied to the input terminal of the inverter 142, through a P-channel MOS transistor 144. The transistor 144 is so connected that, when the decoder connected to the logic circuit produces 10 scale information, the transistor is conductive and when the decoder produces 12 scale information, the transistor is nonconductive. When this transistor is conductive, the inverter produces "0" level voltage onto the input terminal $\alpha$.

Figure 15:
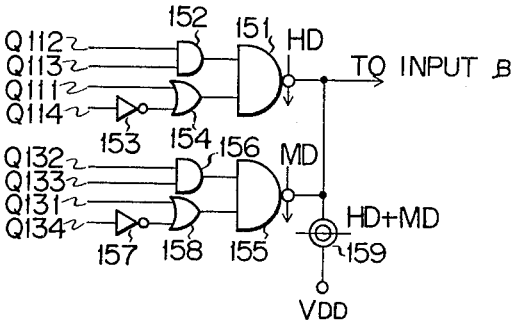

An input terminal $\beta$ in FIG. 11 is energized in such a case that, when the 12 scale counter produces "10", "11" and "12", for example, "1" of the digit 10 of the count output is displayed. To the input terminal $\beta$, the logic circuit shown in FIG. 15 is connected. In the logic circuit, a clocked NAND gate 151 is provided with an input terminal connected via an AND gate 152 to the output terminals Q112 and Q113. The other input terminal of NAND gate 151 is; connected to the output terminal of an OR gate 154 which, in turn, is coupled with the output terminal Q114, via an inverter 153, and with the output terminal Q111 of the hour counter 110. The clocked NAND gate 151 is driven by the HD clock signal generated from the display mode selection circuit to produce an output signal, as in the case of the clocked NAND gate 141 shown in FIG. 14. A clocked NAND gate 156 is provided with an input terminal coupled with the output terminals Q132 and Q133 of the month counter 130 through an AND gate 156. Another input terminal of NAND gate 156 is coupled with an OR gate 158, the inputs of which are connected to the output terminal Q131 and through an inverter 157 to the output terminal Q134. As in the case of the NAND gate 143, the clocked NAND gate 155 is driven by the MD clock signal generated from the display mode selection circuit 51 to produce an output signal. The output terminals of the NAND gates 151 and 155 are coupled with the ground potential power source $V_{DD}$, through a P-channel MOS transistor 159. The transistor 159 is conductive when the decoder coupled with the logic circuit produces 10 scale information, and is non-conductive when the decoder produces 12 scale information, as in the case of the transistor 144 shown in FIG. 14. The output terminals S1 to S7 and S11 to S17 of the decoder of FIGS. 10 and 11 are coupled with the seven display segments (not shown) of the display device, respectively.

In the electronic timepiece basic circuit shown in FIG. 1, the 10 scale counter 9 and the 6 scale counter 15 are changed into the 24 scale counter 110, and the 10 scale counter 10 and the 6 scale counter 16 are changed into the 12 scale counter shown in FIG. 5. The terminals T1 to T6 are connected to the terminals T7 to T12, respectively, in the master slice method, as shown. With this connection, 1 Hz pulses from the pulse generating circuit 1 go through the OR gate G1 of the ROM 6 to the terminals T1 and T2 to the 10 scale counter 7 and the 6 scale counter 13 where seconds are counted. The output pulse of the 6 scale counter 13 is applied to the 10 scale counter 8 and the 6 scale counter 14, through the OR gate G2 and the terminals T3 and T4 where minutes are counted. The output pulse of the 6 scale counter 14 is applied to the 10 scale counter 9 and the 6 scale counter 15, through the OR gate G3 and the terminals T5 and T6 where hours are counted. The output pulse of the 6 scale counter 15 is fed to the 10 scale counter 10 and the 6 scale counter 16, via the OR gate G4 and the terminals T7 and T8 where days are counted. Similarly, the output pulse of the 6 scale counter 16 is applied to the 10 scale counter 11 and the 6 scale counter 17 where months are counted. Further, the output pulse of the 6 scale counter 17 applied to the 10 scale counter 12 and the 6 scale counter 18 where years are counted. Here, if a second, minute and hour display mode is selected by the display mode selection circuit, the output counts of the 10 scale counters 7 to 9 are coupled with the display unit 49 through the AND gate 25 to 27, the OR gates 43 to 45 and the 1-digit decoders 19 to 21, and the output counts of the 6 scale counters 13 to 15 are applied through the AND gates 37 to 39, the OR gates 46 to 48, and the 10-digit decoders 31 to 33 to the display unit 49 where seconds, minutes and hours are displayed.

When a day, month and year mode is selected by the display mode selection circuit 51, day information is supplied from the 10 scale counter and 6 scale counter to the display unit 49; month information from the 10 scale counter 11 and the 6 scale counter 17 to the display unit 49; and year information from the 10 scale counter 12 and the 6 scale counter 18 to the display unit 49.

It is assumed that a specification requires that the 10 scale counter 9 and the 6 scale counter 15 currently used for the hour counter are used for the day counter and that the 10 scale counter 10 and 6 scale counter 16 are used for the hour counter. In this case, the terminals T3 and T4 are coupled with terminals T10 and T9 and the terminals T7, T8, T11 and T12 are connected to the terminals T1, T2, T5 and T6, respectively. Further, the 10 scale counter 10 and the 6 scale counter 16 are constructed as the hour counter 110 shown in FIG. 3 and the 10 scale counter 9 and the 6 scale counter 15, as the day counter 120 shown in FIG. 4. Additionally, when the display mode is divided into the second, minute, hour group and the day, month and year group, connection lines from the display mode selection circuit 51 to the AND gates 27 and 28 are cut off and connection must be made from the display mode selection circuit 51 to the AND gates 28 and 27.

As is known, the ROM 6 includes a detector circuit (not shown) which is connected to the output terminals Q121 to Q127 of the day counter 120 shown in FIG. 4 and the output terminals Q131 to Q134 of the month counter 130 shown in FIG. 5. When it is detected that the day counter 120 produces a count corresponding to the final day of the month displayed by the month counter 130, the detector circuit sets the contents of the day counter 120 to "1". For example, after Feb. 28 is detected by the detector circuit, if a pulse is applied to the day counter 120, the month counter 130 produces a count "3" and the day counter 120 produces a count "1".

While the present invention has been described using an exemplary embodiment, it should be understood that the present invention is not limited to the embodiment mentioned above. For example, the second, minute and hour mode and the day, month and year mode are selectively established by using two signals generated from the display mode selection circuit 51, in the basic circuit shown in FIG. 1. However, the basic circuit may be modified such that more than two modes are selectively established by using three or more signals generated from the display mode selection circuit 51. Further, it is possible to assemble the AND gates 25 to 30 and the AND gates 38 to 42 in the ROM 6, in the basic circuit of FIG. 1.

What we claim is:

1. A programmable electronic timepiece basic circuit comprising:

an oscillating circuit having an output terminal;

a plurality of time counters having input terminals and output terminals, each of said counters being comprised of semiconductor elements;

decoding means coupled to said time counters for decoding the contents of said time counters;

a display unit coupled with said decoding means for displaying the contents of said decoding means; and means interposed between the output of said oscillating circuit and the input of said time counters, said means including first and second pluralities of terminals, each first and second plurality corresponding in number to the number of time counters in said circuit, said interposed means for programming said timepiece into at least two different modes without modifying the oscillating circuit of said timepiece, by selectively connecting said terminals of said first plurality to said terminals of said second plurality in at least two different connective arrangements, at least one terminal of said first plurality of terminals being capable of being connected to at least two different terminals of said second plurality of terminals to achieve said at least two different modes, the output terminal of said oscillating circuit being coupled to one of the terminals in said first plurality, and the input terminals of each of said time counters being coupled to respective ones of the terminals in said second plurality.

2. An electronic timepiece basic circuit according to claim 1, also including a plurality of AND circuits connected between said counters and said decoding means; at least one switching means; and a display mode selection circuit for selectively driving said AND circuits in response to the operation of said switching means.

3. An electronic timepeice basic circuit according to claim 1, in which each of said time counters comprises a 10 scale counter section including a binary counter, two one-bit shift registers and a modified one-bit shift register, and a 6 scale counter section including three one-bit shift registers.

4. An electronic timepiece basic circuit according to claim 3, in which each of said one-bit shift registers comprises a first clocked inverter; a first NAND gate having a first input terminal coupled with said first clocked inverter and a second input terminal for receiving a reset signal; a second clocked inverter having input and output terminals coupled respectively with the output terminal and the first input terminal of said NAND gate; a third clocked inverter having an input terminal coupled with the output terminal of said first NAND gate; a second NAND gate, having a first input terminal connected to said third clocked inverter and a second input terminal for receiving a reset signal; and a fourth clocked inverter having input and output terminals connected respectively to the output terminal and the first input terminal of said second NAND gate.

5. An electronic timepiece basic circuit according to claim 4, in which said first to fourth clocked inverters are each comprised of four field effect transistors connected in cascade fashion between first and second power source terminals.

6. An electronic timepiece circuit according to claim 3, in which said modified one-bit shift register comprises a first clocked inverter; a first NAND gate having a first input terminal coupled with said first clocked inverter and a second input terminal for receiving a reset signal; a second clocked inverter having input and output terminals coupled with the output terminal and the first input terminal respectively, of said first AND gate; a third clocked inverter having an input terminal coupled with the output terminal of said first NAND gate; a second NAND gate having a first input terminal connected to said third clocked inverter and a second input terminal for receiving a reset signal; and a fourth clocked inverter having input and output terminals connected to the output terminal and the first terminal of said second NAND gate, respectively.

7. An electronic timepiece basic circuit according to claim 6, in which said first to fourth clocked inverters are each comprised of four field effect transistors connected in cascade fashion between first and second power source terminals.

8. An electronic timepiece basic circuit according to claim 6, in which said first and third clocked inverters are each comprised of three field effect transistors connected in cascade fashion and said second and fourth clocked inverters are each comprised of four field effect transistors connected in cascade fashion.

9. An electronic timepiece basic circuit according to claim 3 in which said modified one-bit shift register is modifiable to the same construction as said one-bit shift register for converting said 10 scale counter section to a 12 scale counter section.

10. An electronic timepiece basic circuit according to claim 1, also including at least one switching means, and a correction mode selection circuit having output terminals coupled with said first plurality of terminals through OR gates for producing a correction mode selection signal through one of said output terminals, in response to the switching operation of said switching means.

11. An electronic timepiece basic circuit according to claim 1 in which each of said time counters comprises the same circuit elements interconnected in the same fashion.

12. An electronic timepiece basic circuit according to claim 11 in which said each of said time counters is modifiable to a different mode.

13. An electronic timepiece basic circuit according to claim 1, in which each of said time counters comprises a first shift register, second to fourth shift registers which are cascade-connected and driven by an output signal from said first shift register, an output terminal of said fourth shift register being coupled to an input terminal of said first shift register, and a plurality of additional shift registers cascade-connected and driven by an output signal from said fourth shift register, an output terminal of the last stage of said plurality of additional shift registers being connected to an input terminal of the first stage of said plurality of additional shift registers.

14. An electronic timepiece basic circuit according to claim 13, wherein each of the shift registers of said time counters is formed of first, second, third and fourth clocked inverters, a first NAND gate circuit having a first input terminal connected to output terminals of said first and second clocked inverters and having an output terminal connected to input terminals of said second and third clocked inverters, and a second NAND gate circuit having a first input terminal connected to output terminals of said third and fourth inverters, having a second input terminal connected to a second input terminal of said first NAND gate circuit and having an output terminal connected to an input terminal of said fourth inverter.

15. An electronic timepiece basic circuit according to claim 14, wherein each of said first to fourth inverters comprises first, second, third and fourth field effect transistors, said second and third field effect transistors having gates thereof connected together.

16. An electronic timepiece basic circuit according to claim 14, wherein each of said second and fourth inverters of said fourth shift register is formed of first, second, third and fourth field effect transistors, said second and third field effect transistors having gates thereof connected together, and each of said first and third inverters of said fourth shift register is formed of fifth, sixth and seventh field effect transistors, said sixth and seventh field effect transistors having gates thereof connected together, and each of said first to fourth inverters of each of the remaining shift registers is formed of eighth, ninth, tenth and eleventh field effect transistors, said ninth field effect transistors being connected together.

* * * * *